US007833078B2

(12) United States Patent
Kretzschmar

(10) Patent No.: US 7,833,078 B2
(45) **Date of Patent: *Nov. 16, 2010**

(54) CONSTRUCTION KIT

(75) Inventor: Michael Kretzschmar, Hamburg (DE)

(73) Assignee: MEGA Brands International S.A.R.L., Luxembourg, Zug Branch, Zug Branch ( * ) Notice: Subject to any disclaimer, the term of this patent is extended or adjusted under 35 U.S.C. 154(b) by 424 days.

This patent is subject to a terminal disclaimer.

(21) Appl. No.: 11/429,231

(22) Filed: May 8, 2006

(65) Prior Publication Data

US 2006/0205316 A1 Sep. 14, 2006

Related U.S. Application Data

(63) Continuation of application No. 10/503,295, filed as application No. PCT/EP02/13311 on Nov. 26, 2002, now Pat. No. 7,066,778.

(30) Foreign Application Priority Data

Feb. 1, 2002 (DE) ..... 202 02 183 U

(51) Int. Cl.
*A63H 33/04* (2006.01)
*A63H 33/26* (2006.01)

(52) U.S. Cl. ..... 446/92; 446/137

(58) Field of Classification Search ..... 446/85, 446/92, 137–139, 901; 434/190, 208, 277–279; 273/157 R See application file for complete search history.

(56) References Cited

U.S. PATENT DOCUMENTS 242,821 A * 6/1881 Farmer ..... 434/280
744,718 A 11/1903 Cassidy
1,236,234 A 8/1917 Troje
1,535,035 A 4/1925 Philipp
2,448,692 A 9/1948 Teetor
2,795,893 A 6/1957 Vayo
2,846,809 A 8/1958 Majewski
2,872,754 A * 2/1959 Cronberger ..... 446/92
2,939,246 A 6/1960 Glos, II
2,949,697 A 8/1960 Licitis et al.
2,970,388 A * 2/1961 Yonkers ..... 434/277
2,983,071 A 5/1961 Oliver
3,077,696 A 2/1963 Barnett et al.
3,095,668 A 7/1963 Dorsett (Continued)

FOREIGN PATENT DOCUMENTS

DE 33 23 489 A1 1/1984

(Continued)

OTHER PUBLICATIONS

Japanese Office Action and English Translation Thereof.

(Continued)

*Primary Examiner*—Alvin A Hunter
*Assistant Examiner*—Alyssa M Hylinski
(74) *Attorney, Agent, or Firm*—Plumsea Law Group, LLC

(57) ABSTRACT

Construction kit with two- and/or three-dimensional construction elements (1, 9) with magnetic elements (4) in the corners and/or sides and ferromagnetic spheres (11), which can be placed between the magnetic elements (4) of adjacent construction elements (1, 9) to connect the construction elements (1, 9) together using a magnetic bond so that they can be detached.

28 Claims, 5 Drawing Sheets

U.S. PATENT DOCUMENTS

| | | | | | |
|---|---|---|---|---|---|
| 3,184,882 | A | | 5/1965 | Vega | |
| 3,196,579 | A | | 7/1965 | Lepper et al. | |
| 3,254,440 | A | | 6/1966 | Duggar | |
| 3,411,237 | A | | 11/1968 | Crosman | |
| 3,453,773 | A | | 7/1969 | Compton et al. | |
| 3,458,949 | A | | 8/1969 | Young | |
| 3,466,795 | A | | 9/1969 | Friedman | |
| 3,594,924 | A | | 7/1971 | Baker | |
| 3,601,921 | A | | 8/1971 | Stromaier | |
| 3,606,333 | A | | 9/1971 | Green | |
| 3,696,548 | A | | 10/1972 | Teller | |
| 3,706,158 | A | | 12/1972 | Jensen | |
| 3,775,901 | A | | 12/1973 | Ellman et al. | |
| 3,798,833 | A | | 3/1974 | Campbell | |
| 3,867,786 | A | | 2/1975 | Greenblatt | |
| 3,906,658 | A | | 9/1975 | Gross | |
| 3,979,855 | A | * | 9/1976 | Schmidt et al. | 446/112 |
| 3,998,003 | A | | 12/1976 | Rosenbaum | |
| 3,998,004 | A | * | 12/1976 | Ehrlich | 446/92 |
| 4,109,398 | A | | 8/1978 | Hida | |
| 4,118,888 | A | | 10/1978 | Ogawa | |
| D253,121 | S | | 10/1979 | Hida | |
| 4,238,905 | A | | 12/1980 | MacGraw, II | |
| D260,662 | S | | 9/1981 | Hida | |
| D264,694 | S | | 6/1982 | Takahashi | |
| 4,334,870 | A | | 6/1982 | Roane | |
| 4,334,871 | A | | 6/1982 | Roane | |
| 4,364,196 | A | | 12/1982 | Shacket | |
| 4,650,424 | A | | 3/1987 | Mitchell | |
| 4,722,712 | A | | 2/1988 | McKenna | |
| 4,726,800 | A | | 2/1988 | Kobayashi | |
| 4,741,534 | A | | 5/1988 | Rogahn | |
| D301,161 | S | | 5/1989 | Dunse | |
| 4,836,787 | A | | 6/1989 | Boo | |
| 4,886,273 | A | | 12/1989 | Unger | |
| 5,009,625 | A | * | 4/1991 | Longuet-Higgins | 446/92 |
| 5,021,021 | A | | 6/1991 | Ballard | |
| 5,028,053 | A | | 7/1991 | Leopold | |
| 5,045,013 | A | | 9/1991 | Fujitani | |
| 5,088,951 | A | | 2/1992 | Majurinen | |
| 5,127,652 | A | | 7/1992 | Unger | |
| 5,297,981 | A | | 3/1994 | Maxim et al. | |
| 5,310,183 | A | * | 5/1994 | Glikmann | 273/153 S |
| 5,347,253 | A | | 9/1994 | Ogikubo | |
| 5,409,236 | A | * | 4/1995 | Therrien | 273/288 |
| 5,411,262 | A | | 5/1995 | Smith | |
| 5,520,396 | A | | 5/1996 | Therrien | |
| 5,643,038 | A | | 7/1997 | Olsen et al. | |
| 5,746,638 | A | * | 5/1998 | Shiraishi | 446/92 |
| 5,785,529 | A | | 7/1998 | Hearn et al. | |
| 5,826,872 | A | | 10/1998 | Hall | |
| 5,833,465 | A | | 11/1998 | Jarzewiak | |
| 5,848,926 | A | | 12/1998 | Jardetzky | |
| 5,897,417 | A | | 4/1999 | Grey | |
| 6,024,626 | A | * | 2/2000 | Mendelsohn | 446/92 |
| 6,116,981 | A | | 9/2000 | Zheng | |
| 6,158,740 | A | | 12/2000 | Hall | |
| 6,241,249 | B1 | * | 6/2001 | Wang | 273/156 |
| 6,256,914 | B1 | | 7/2001 | Yeh | |
| 6,280,282 | B1 | | 8/2001 | Puchalski | |
| 6,386,540 | B1 | | 5/2002 | Stevkovski | |
| 6,431,936 | B1 | | 8/2002 | Kiribuchi | |
| 6,491,563 | B1 | | 12/2002 | Bailey | |
| 6,566,992 | B1 | | 5/2003 | Vicentelli | |
| 6,626,727 | B2 | | 9/2003 | Balanchi | |
| 6,846,216 | B1 | * | 1/2005 | Balanchi | 446/85 |
| 6,963,261 | B2 | | 11/2005 | Vicentelli | |
| 6,969,294 | B2 | | 11/2005 | Vicentelli | |
| 7,066,778 | B2 | * | 6/2006 | Kretzschmar | 446/92 |
| 7,140,944 | B2 | | 11/2006 | Harris | |
| 2002/0115373 | A1 | | 8/2002 | Lazerman | |
| 2002/0135125 | A1 | | 9/2002 | Wu | |
| 2002/0167127 | A1 | | 11/2002 | Fang | |
| 2003/0148699 | A1 | * | 8/2003 | Balanchi | 446/85 |
| 2006/0205316 | A1 | | 9/2006 | Kretzschmar | |

FOREIGN PATENT DOCUMENTS

| | | | |
|---|---|---|---|
| DE | 3910304 | A1 * | 10/1990 |
| FR | 2 153 792 | | 5/1973 |
| GB | 2 123 306 | | 2/1984 |
| JP | 40-32360 | | 11/1940 |
| JP | 48-087510 | | 7/1948 |
| JP | 50-35357 | | 7/1948 |
| JP | 54-48795 | | 9/1952 |
| JP | 56-81770 | | 11/1954 |
| JP | 57-54170 | | 9/1955 |
| JP | 57-116283 | | 12/1955 |
| JP | 53-15945 | | 2/1978 |
| JP | 57-13085 | | 1/1982 |
| JP | 57-45881 | | 3/1982 |
| JP | 60-43397 | | 3/1985 |
| JP | 61-109600 | | 7/1986 |
| JP | 62-78969 | | 5/1987 |
| JP | 1-82082 | | 6/1989 |
| JP | 2-23579 | | 2/1990 |
| JP | 2-118600 | | 9/1990 |
| JP | 2-264690 | | 10/1990 |
| JP | 3052774 | | 7/1998 |
| JP | 3068102 | | 2/2000 |
| WO | WO 99/60583 | | 11/1999 |
| WO | WO02055168 | A1 * | 7/2002 |

OTHER PUBLICATIONS

German Office Action (dated Jun. 27, 2002).
International Search Report (dated Apr. 14, 2003).
Magna-Tiles Instruction Booklet, date unknown.
International Search Report (dated Mar. 26, 2009).
Electro Mag (dated Jan. 15, 2009).
Electro Mag Series (undated).
International Search Report dated Jan. 16, 2009.

* cited by examiner

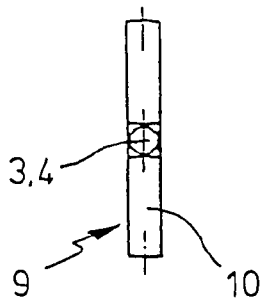
FIG.3c
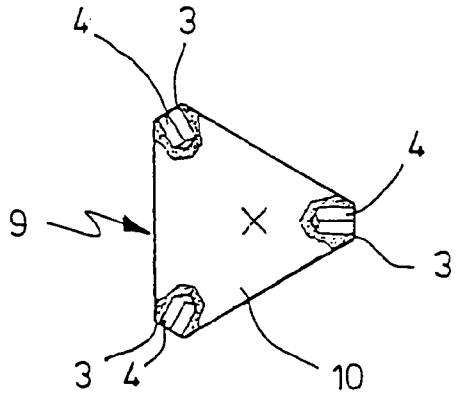
FIG.3a
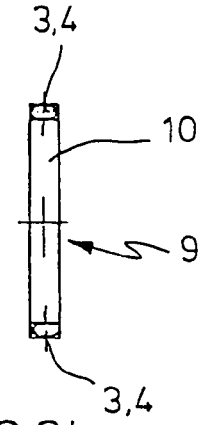
FIG.3b
FIG.4a
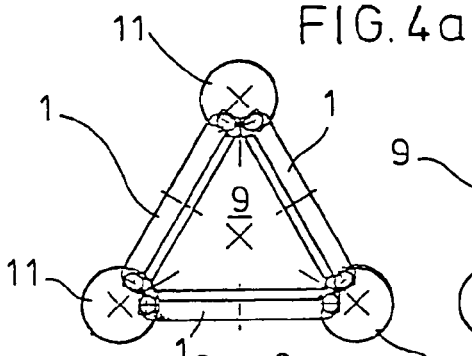
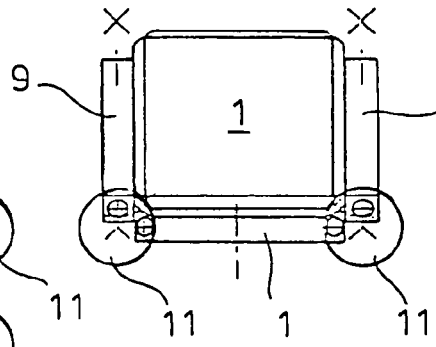
FIG.4b
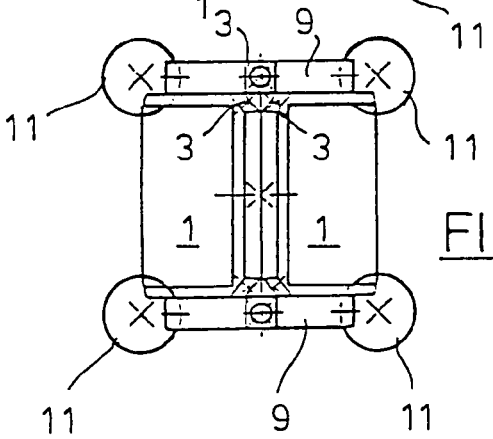
FIG.4c
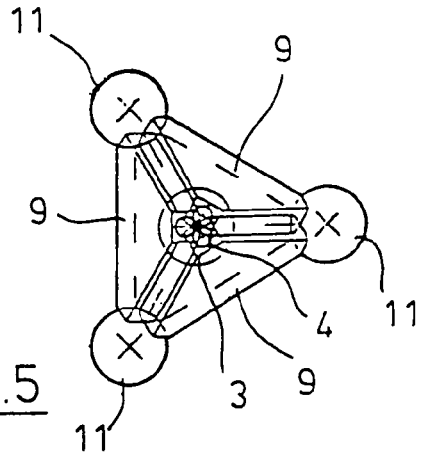
FIG.5

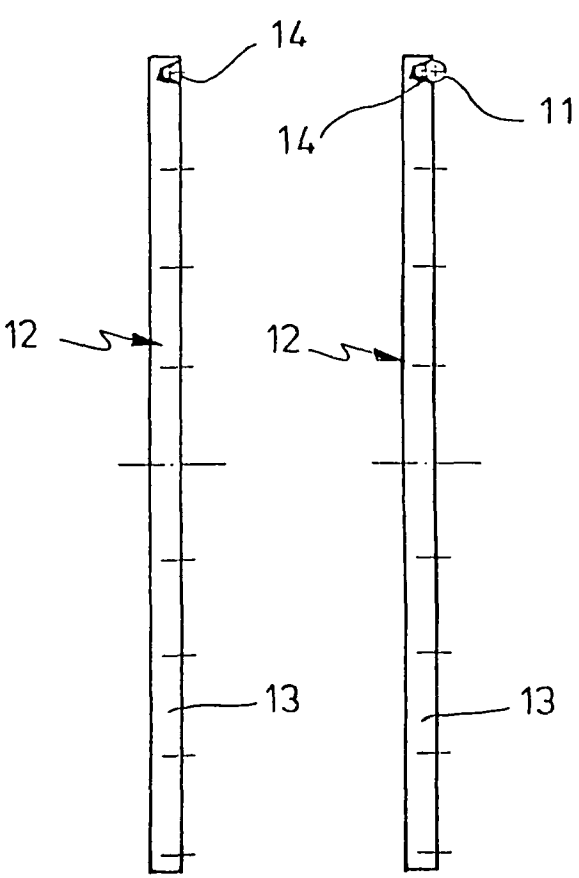
FIG.6c
FIG.6b
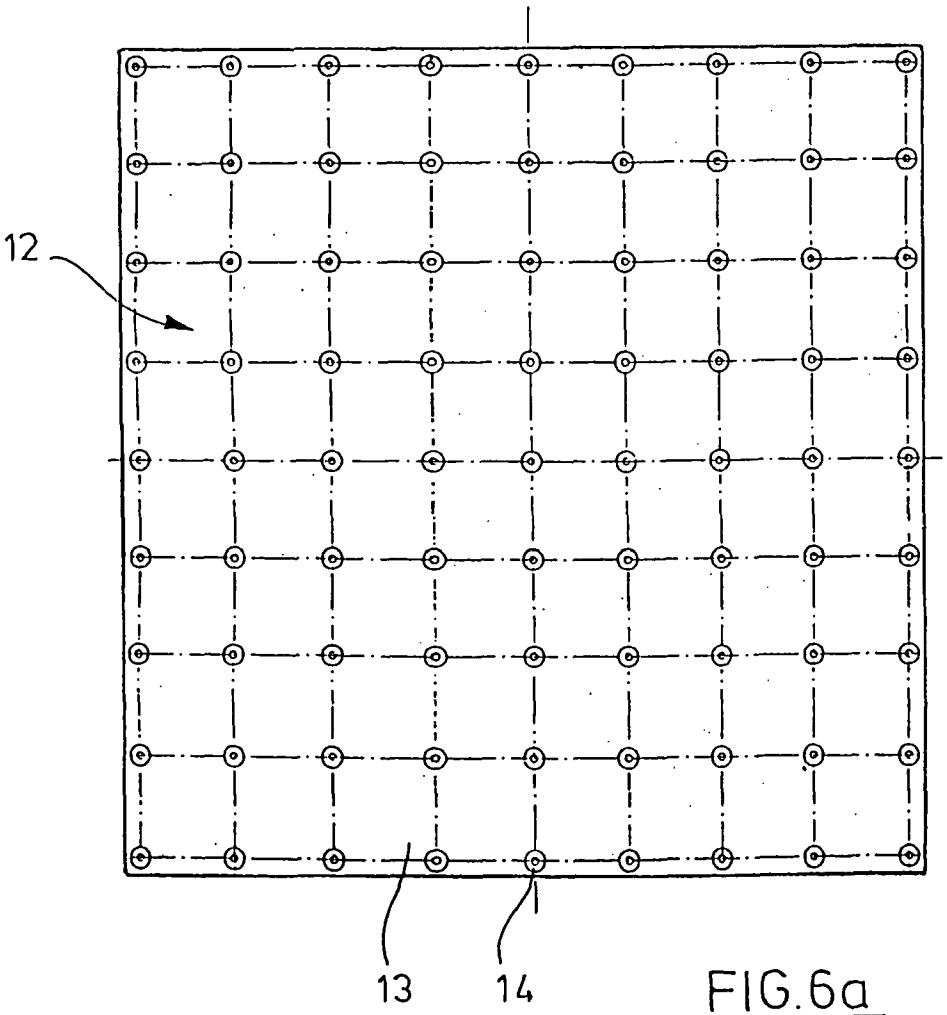
FIG.6a

| MAGTOUCH |
| --- |
| Cube |

| Model | Page |
| --- | --- |
| Square + 1 sphere | 1 |
| Rectangle + 1 sphere | 2 |
| from the triangles 1 figure + 1 sphere (free choice) | 3 |
| Trapezoid + 1 sphere | 4 |
| 2 spheres | 5 |
| free choice 1 figure + 1 sphere or 4 spheres | 6 |

magtouch - smiley
or
magtouch - joker

CONSTRUCTION KIT

This application is a continuation of U.S. patent application Ser. No. 10/503,295, filed Feb. 17, 2005 now U.S. Pat. No. 7,066,778, which is herein incorporated by reference in its entirety, and which was the national stage of International Application No. PCT/EP02/13311, filed Nov. 26, 2002, which claims priority to German Patent Application No. DE 202 02 183.1, filed Feb. 1, 2002.

BACKGROUND

1. Field of the Invention

The invention refers to a construction kit which consists of construction elements with magnetic elements and ferromagnetic spheres.

Construction kits of the type mentioned initially are intended particularly for use as children's toys, educational toys, for producing decorative objects or for applications in technology, for example, for producing architectural models.

2. Background of the Invention

A construction kit is already known which contains construction elements in the form of plastic rods with two permanent magnets in the ends and ferromagnetic spheres, which can be placed between the end side magnets of two construction elements to join these with a magnetic bond which can be detached. Two- and three-dimensional, network-like structures of various different designs can be formed with these construction elements.

The structures made of bar-shaped and spherical components are relatively unstable. Therefore, relatively strong permanent magnets are used and a small pin made of iron or ferromagnetic material is inserted in each plastic rod between the two magnets to increase the magnetic bonding forces.

A further disadvantage of the known construction kit is that it can only be used to make network-type or "open structures."

A construction kit of the type described above is the subject of WO 99/60583 A1.

DE 39 10 304 A1 discloses a construction kit, in which the construction elements have ferromagnetic contact surfaces and the connections are permanent magnets or contain these (claim 1). According to claim 3, the construction elements may particularly be panels and the connections particularly spheres. Claim 4 refers, amongst other things, to the contact surfaces of the construction elements, which are concave and are adapted to the convex surfaces of the connections (e.g., spheres). The structure of the spheres is illustrated in FIG. 2 and described in column 4, line 60 to column 5, line 57. These spheres have a very complex structure and are very expensive to manufacture. In use, they have the disadvantage that the construction elements can only aligned at certain angles to the spherical connections, as otherwise an adequate magnetic bond cannot be brought about.

DE 33 23 489 A1 discloses a toy and means of instruction based on spherical elements, in which the spheres contain magnetic elements. The spheres serve to clamp and hold in place strip-type elements via the magnetic forces which are acting between spheres in different layers. This is illustrated in FIG. 3. The strips are made of "Perspex" and do not contain any ferromagnetic elements.

BRIEF SUMMARY OF THE INVENTION

On the basis of the above, the object of the invention is to create a construction kit, which is not restricted to the creation of network-like structures and in which the structures are stabilized sufficiently well without special measures to increase the magnetic bonding forces.

The problem is solved by a construction kit with the characteristics contained in claim 1. Advantageous embodiments of the construction kit are stated in the sub-claims.

The construction kit according to the invention has two- or three-dimensional construction elements with magnetic elements in the corners and/or the sides and ferromagnetic spheres, which can be inserted between the magnetic elements of adjacent construction components to connect the construction elements together by magnetic bonding in such a way that they can be detached.

Since the construction kit includes two- and/or three-dimensional construction elements, the stability of the structures created with the aid of these construction elements and with ferromagnetic spheres is significantly better in comparison with the known construction kit with rod-type construction elements. This makes it possible only to use relatively weak magnets and to avoid additional ferromagnetic components within the construction elements. The construction of particularly large, stable structures is also supported. In addition, the two- or three-dimensional construction elements have the advantage that they make it possible to assemble more or less closed structures which increases the incentive to play game and permits many interesting applications. Moreover, the use of less strong magnetic forces avoids disruptive magnetic fields, which, for example, attract shall parts or can impair clocks or other components containing precision mechanisms.

The two-dimensional components extend substantially in one plane, having however, a certain transverse expansion in respect of the plane. The three-dimensional construction elements extend significantly in all spatial directions. In contrast to this, the rod-type construction elements of the prior art only extend significantly along one axis and only have a low level of expansion in the transverse direction.

In two-dimensional construction elements, the magnetic elements are preferably aligned substantially with the line bisecting the angle of the corners of the two large parallel side surfaces of the panel-type construction elements. Here, the magnetic elements are preferably arranged at the corners parallel to the two large side surfaces, preferably approximately in the middle between the two.

In three-dimensional construction elements, the magnetic elements are preferably aligned substantially with all the lines bisecting the angles which delineate these three-dimensional corners. This means, for example, in a cube, that the magnetic elements are aligned substantially with diagonals which run from the centre of the cube to its corners.

The two-dimensional construction elements can, for example, be arched two-dimensional components. The two-dimensional or three-dimensional construction elements may be produced in a wide range of shapes. They can be closed construction elements or open construction elements, for example, frame-type construction elements which run in one plane, or delineate a three-dimensional shape.

According to a preferred embodiment, the construction elements are panel-shaped. A very large number of interesting and particularly stable structures can be realized with the panel-type construction elements.

The magnetic elements are preferably arranged in corners of the construction elements. In addition to, or instead of this, they can be arranged in the sides of the construction elements, particularly in the narrow sides of the two-dimensional construction elements.

The panel-type construction elements can be construction elements with any desired number of corners. The panel-type construction elements can also have curved sides. According to a further embodiment, the construction kit includes triangular and/or rectangular and/or hexagonal and/or octagonal and/or round and/or half-round panel-type construction elements.

According to a further embodiment, the construction kit includes triangles with equal and/or unequal sides and/or square and/or double square and or multiple square panel-type construction elements.

According to one embodiment, the construction kit includes polyhedral (e.g., cube-shaped, cuboid, prism-shaped, pyramidal, truncated pyramid-shaped) and/or spherical and/or spherical segment-shaped and/or cylindrical and or cylindrical segment-shaped and/or barrel-shaped and/or barrel segment-shaped and/or ring-shaped and/or arc-shaped three-dimensional construction elements.

According to one embodiment, the construction kit includes construction elements which have a bevel on their edges. This makes it easier to butt a number of construction elements together at the edges.

According to one embodiment, the construction kit includes construction elements, the walls of which are thinner between their edges than on the edges.

According to one embodiment, the construction kit includes construction elements, which have cut-outs on the corners and/or sides to take a section of a sphere. This makes it possible to bring the construction elements very close together or to house the spheres mainly in the corners of the construction elements.

According to a further embodiment, the cut-outs are formed by bevels on the corners of the construction element and/or substantially spherical segment-shaped or trough-shaped recesses on the corners and/or the sides of the construction elements.

According to one embodiment, the magnetic elements with their axes are aligned substantially with a line bisecting the corners. This aligns the magnetic retaining forces advantageously with the construction elements or the spheres. According to one embodiment of the construction elements with magnetic elements in the sides, the magnetic elements are aligned for this purpose with their axes substantially perpendicular to the sides and/or the cut-outs in the sides.

According to a further embodiment, the magnetic elements are cylindrical.

According to a preferred embodiment, the magnetic elements are permanent magnets. However, it is also possible as a matter of principle for the magnetic elements to take the form of electromagnets.

The construction kit particularly includes construction elements of a rigid design. According to one embodiment, the construction kit includes at least one construction element which can be changed in shape. This construction element can be shaped manually by the user or with a tool. It can particularly involve a construction element which can be shaped plastically or elastically. In this way, the user can construct structures which leave the preset grid of the construction elements. He can also bring stress states into his structures by means of elastically deformable construction elements.

According to one embodiment, the construction kit includes at least one construction element with a light source. The user can achieve interesting lighting effects with this. The construction element is also preferably provided with magnetic elements in the way already described and can be integrated into structures by means of ferromagnetic spheres. However, it may also demonstrate other assembly techniques, for example, suction cup fastenings.

According to a preferred embodiment, an electrical light source is involved. According to a further embodiment, the construction kit includes an electrical voltage source, e.g., a battery, an accumulator, or a power pack. The voltage source can be used to supply the electric light source and/or electromagnetic elements. It can, for example, be integrated in a further construction element or in the construction element with the light source, for example, if using a button cell battery. However, it can also be integrated into the base plate or into a separate construction element.

According to a further embodiment, the construction elements are at least partially made of plastic and/or metal and/or wood. The magnetic elements and/or light sources or a holder for the latter and/or the voltage source may particularly be cast in and/or injection-molded and/or inserted into the construction elements.

The construction elements are preferably made of injection-molded plastic.

According to one embodiment, the construction kit includes at least one cube with differently marked faces. The faces of a cube can all be marked differently or only some of them may be different. Symbols and/or designations of construction elements and/or spheres and/or special game instructions are preferably arranged on the faces. For example, one or more players can use the cube to throw dice for construction elements or spheres which they may then use for a design. It can then be determined in a sort of competition who has built the highest, most daring or most beautiful design with the construction elements won. A designation, to which a special game instruction is allocated, can, for example, be a "joker." Throwing the joker can, for example, permit a player to select any construction element he wants. Another "designation" can, for example, be a face with nothing on it at all. If a player throws a blank of this kind, he may not take a construction, element. A further feasible designation is a number, which designates the number of components the player may take.

According to one embodiment, the construction kit includes black and/or white and/or colored construction elements and/or ferromagnetic spheres. The construction kit can particularly include construction elements and/or spheres in different colors or in black or in white.

Furthermore, an advantageous embodiment provides for the construction kit including a base plate which has recesses and/or other surface structures and/or other magnetic elements in which the spheres and/or construction elements can be inserted and/or with which spheres and/or construction elements can be connected by magnetic bonding so that they can be detached. Building up from the base plate, structures can be erected advantageously starting from the grid which is specified by the base plate. The base plate is a useful aid to the construction of stable structures, especially if these reach large dimensions.

It is also possible to provide a base plate with recesses and/or other surface structures and/or further magnetic elements on both sides, for example in different grids, to permit different structures to be constructed. A double-sided structure of this type can also be used to cover structures and then erect new structures on top of it.

According to one embodiment, the recesses and/or other surface structures reveal a spherical and/or an elongated shape. This permits the base plate to be used for the erection of construction elements which have different edge lengths, for example, for square plates and triangles, equilateral or non-equilateral triangles.

According to one embodiment, the base plate is produced in black and/or white and/or colored. According to one embodiment, the base plate is made of plastic. Moreover, the farther magnetic elements of the base plates are preferably permanent magnets. Especially in a base plate, the other magnetic elements can also be electromagnets in order to give the entire structure a special stability via particularly strong magnetic forces.

According to one embodiment, the construction kit includes a container with a lower part with compartments containing construction elements and spheres and an upper part which can be removed from the lower part to form the base plate. The upper part therefore has a double function as the base for playing and a cover for the container for storing and transporting the construction elements and spheres.

According to one embodiment, the construction kit includes a container with a lower part and a hinged lid, each made of plastic and at least one insert with compartments containing construction elements and spheres. According to one embodiment, the insert also consists of plastic. According to one embodiment, the container and/or the insert consists of a transparent plastic. According to one embodiment, the hinged lid is attached to the lower part via a film hinge. According to one embodiment, the container and/or the insert is folded from a flat plastic material and connected at the corners by adhesive, welding or another type of connection. According to one embodiment, the construction kit contains a base plate inserted in it.

BRIEF DESCRIPTION OF THE DRAWINGS

The invention is described in greater detail below using the attached drawings of examples of embodiments.

FIGS. 3*a* to *c* are a top view (FIG. 3*a*), a view from the left side (FIG. 3*b*) and a view from the right side (FIG. 3*c*) of a triangular two-dimensional construction element;

FIGS. 4*a* to *c* are a front view (FIG. 4*a*), side view (FIG. 4*b*) and a further side view (FIG. 4*c*) of a prism structure formed with construction elements according to FIGS. 1 and 3 plus ferromagnetic spheres;

FIG. 5 is a top view of a pyramidal structure, formed from construction elements according to FIG. 3 and ferromagnetic spheres;

FIGS. 6*a* to *c* are a top view (FIG. 6*a*), a side view (FIG. 6*b*) and the same side view with a sphere inserted (FIG. 6*c*) of a base plate with recesses to hold spheres;

DETAILED DESCRIPTION OF THE INVENTION

In the explanation of a number of different examples of embodiments below, corresponding characteristics are provided with the same reference numbers.

Figure 1A:
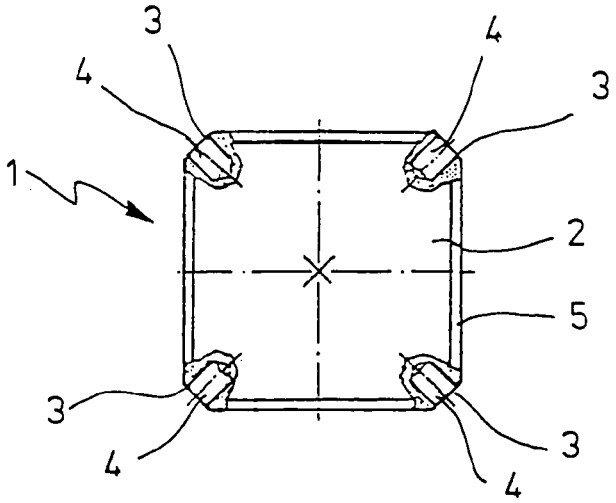
FIGS. 1*a* and *b* are a top view (FIG. 1*a*) and a side view (FIG. 1*b*) of a square panel-type construction element.
Figure 1B:
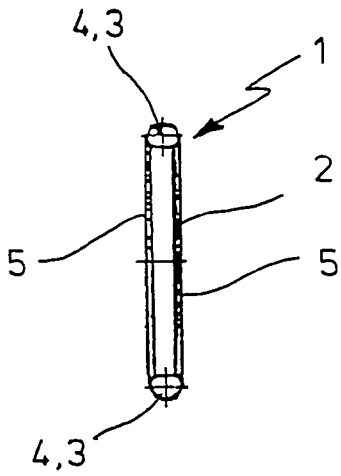

According to FIG. 1, a square, panel-type construction element 1 has a plate 2, which has a small bevel 3 at an angle of 45° to the edges in each of the four corners.

Furthermore, there is a magnetic element 4 inserted in each corner in the form of a small cylindrical permanent magnet. The axes of the magnetic elements 4 are aligned precisely with the line bisecting the edges of the panel 2 adjacent to the corners or aligned with the centre of the panel 2.

Furthermore, the panel 2 has a bevel 5 running around the edges on both sides.

In the example, the panel 2 has side lengths of approximately 40 mm and a wall thickness of approximately 5 mm. Moreover, in the example, magnets 4 are inserted with a diameter of approximately 4 mm and a length of approximately 5 mm.

Figure 2A:
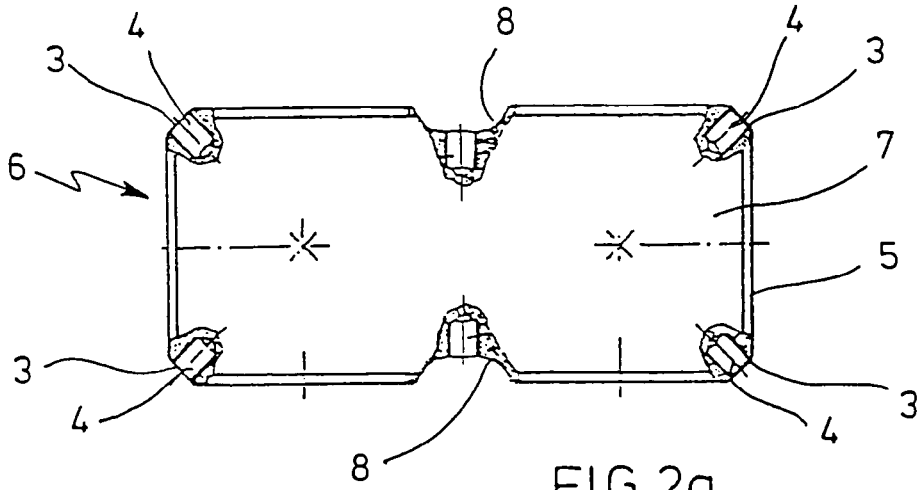
FIGS. 2*a* and *b* are a top view (FIG. 2*a*) and a side view (FIG. 2*b*) of a double square two-dimensional construction element.
Figure 2B:
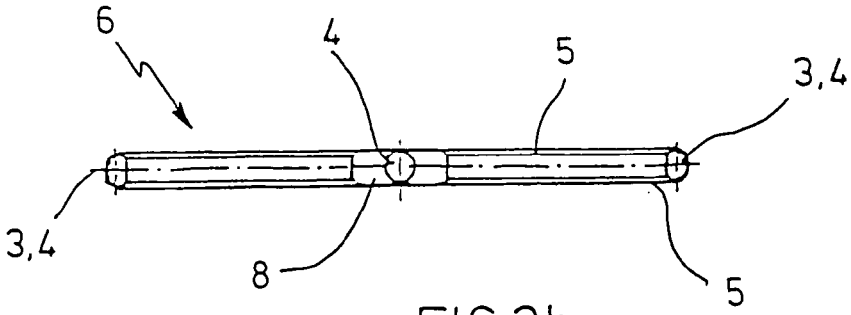

FIG. 2*a* shows a double square panel-type construction element 6, which produces a panel 7 with double the side length of panel 1 (approximately 80 mm). The panel 7 has bevels 3 on the corners. Magnets 4 are again integrated there in the panels 7. A bevel 5 runs around the edge on both sides on the outside.

Furthermore, the panel-type construction element 6 has trough-shaped recesses 8 in the centre of the two long edges. Magnetic elements 4 are again arranged in the bottom of these recesses 8 in the panel.

The recesses 8 are dimensioned such that a region of spheres with a diameter of 12.7 mm (½ inch) can be held in them.

The recesses 8 have a width of approximately 13 mm and a depth of approximately 3.5 mm in the example.

According to FIG. 3, a triangular panel-type construction element 9 comprises a panel 10 in the form of an equilateral triangle, which has bevels 3 at the edges which run perpendicular to the line bisecting the angle between the sides adjacent to the corners.

In the panel 10, there are magnetic elements 4, which in turn lie under the bevels 3, with a cylindrical shape, the axes of which are aligned with the line bisecting the angle at the corners.

The side length of the panel 10, i.e., the distance from a hypothetical corner to the other measured distance corresponds to the side lengths of the panel 2, i.e., amounts to approximately 40 mm. The panel 10 also has a wall thickness of approximately 5 mm.

According to FIGS. 4 and 5, the construction elements 1 and 9, described above, are used with ferromagnetic spheres 11, to produce structures. During this, the ferromagnetic spheres 11 are each placed over the magnetic elements 4, so that the distance between the centers of the spheres is approximately 45 mm.

According to FIG. 4*a* to *c* a prism-shaped structure is realized from three square panel-type construction elements 1, two triangular panel-type construction elements 9 and six ferromagnetic spheres 11. The spheres have been omitted in some cases in the views in order to give a clear view of the bevels 3 and the magnetic elements 4. It can clearly be seen that a section of the spheres 11 is placed in the region of the bevels 3 and that as a result of this the construction elements 1, 9 can be butted tightly against each other.

FIG. 5 shows a pyramidal or tetrahedral structure, formed from four triangular panel-type construction elements 9 and four ferromagnetic spheres 11.

Of course, the construction elements 1, 9, 6 and any other construction elements included in this invention can be combined together to form structures of practically any desired size and complexity. Dimensions different from those stated are also possible.

According to FIG. 6, a base plate 12, comprising a panel-type body 13, which has a large number of recesses 14 on at least one side, serves as an aid to the erection of structures. In the example, cone-shaped recesses have been selected, but they can also take other shapes. The recesses 14 have the advantage that spheres 11 inserted in them are only held by a line around the circumference so that although they are fixed precisely, they can be removed again with the application of little force.

In the example, the base plate is approximately square and has a side length of approximately 500 mm. The distance between the recesses 14 corresponds to the distance between the centers of the spheres if they are allocated to the magnets 4 on construction elements 1, 6, 9 i.e., approximately 45 mm.

The construction elements 1, 6, 9 and/or the base plate 12 can be manufactured particularly from plastic, especially using injection-molding. The magnetic elements 4 can be surrounded by the plastic material in the injection-molding process.

The spheres 11 are made of a ferrous material, which is attracted by a magnet. It is preferable for a non-rusting ferrous material to be used. The spheres 11 can also be coated.

Figure 7:
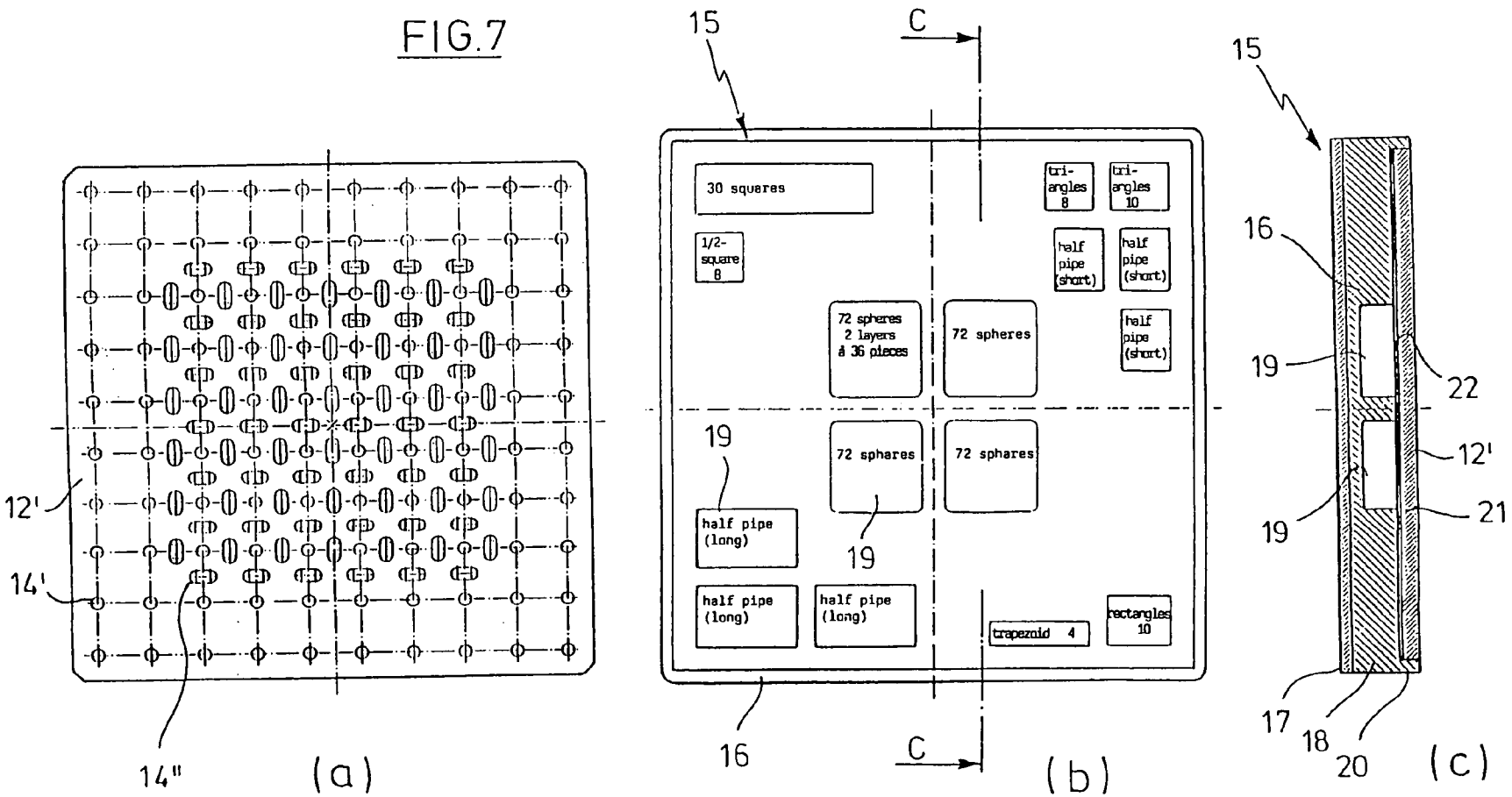
FIGS. 7*a* to *c* are a top view (FIG. 7*a*) of the upper part of a container for construction elements and spheres, a top view of the lower part (FIG. 7*b*) and a vertical section (FIG. 7*c*)

According to FIG. 7, a container 15 includes a lower part 16 with a base part 17 and a holder part 18, in which various compartments 19 are formed. The compartments 19 serve as containers for the construction elements and spheres. Their size is adapted to the respective construction elements and spheres they are to hold.

The holder part 18 has an edge 20 around its circumference which delineates a mounting.

An upper part 21 is inserted in the mounting. This includes a base plate 12', which apart from circular recesses 14' also includes a longitudinal recess 14", the ends of which are rounded. The width of the longitudinal recesses 14" corresponds to the diameter of the circular recesses 14' and their length corresponds to three times the diameter of the circular recesses 14'.

The recesses 14' 14" are holes which pass through the base plate 14'. The upper part 21 includes a thin cover plate 22, which is arranged under the base plate 12' and covers the holes.

The container 15 can be made entirely or partially of plastic and/or wood and/or metal (e.g., aluminum) or another suitable material.

Figure 8:
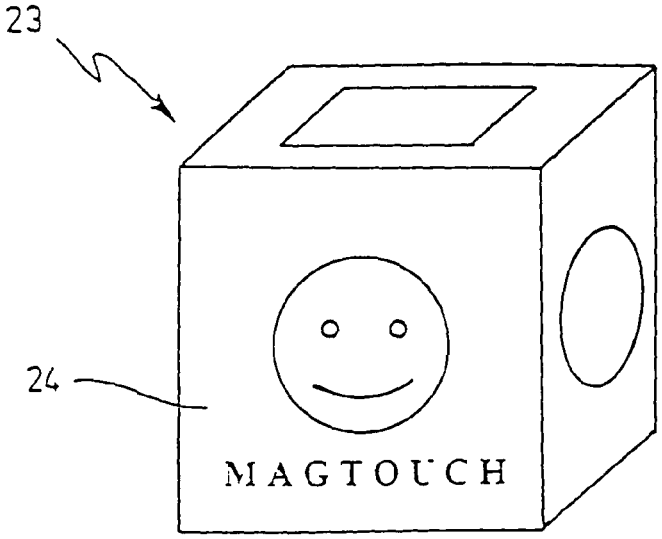
FIG. 8 is a perspective side view of a dice.

According to FIG. 8, a cube 23 that forms part of the construction kit has six faces 24 with different symbols.

Figure 9:
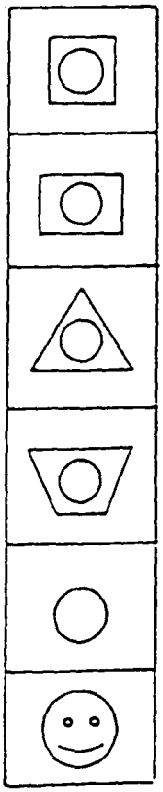
FIG. 9 is a table with dice symbols and rules of the game.

The allocation of the symbols to the faces is shown in the table in FIG. 9. The rules of the game are also clear from this, which must be observed by a player when throwing the a certain symbol using the cube as a dice:

If the first face is thrown, the player may take one square construction element and one sphere.

If the second face is thrown, he has a rectangular construction element and a sphere.

If the third face is thrown, the player is entitled to take a triangular construction element and a sphere from the stock available.

With fourth face, he receives a trapezoidal construction element and a sphere.

If the player throws the fifth face with the dice, he gets two spheres.

If he throws the sixth face, he can choose between any construction element he would like or up to four spheres.

Any number of desired variations is possible.

Using one or more dice 22, it is possible, for example, to undertake competitions, organized between different players. Each player has a certain number of dice and he must build a structure with the stock of construction elements and spheres he has gained by throwing the dice. The results are compared on the basis of one or more specific criteria (e.g., height of the structure), thus selecting a winner.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A toy construction element comprising:

a body made of nonmagnetic material extending in substantially one plane;

a first magnet disposed in the body, the first magnet having an outer surface that is symmetrical about a first magnetic axis and at least one planar face that is perpendicular to the first magnetic axis, the first magnetic axis aligned with a center of the body, the at least one planar face of the first magnet disposed adjacent to a first edge of the body, and the first magnetic axis generally perpendicular to the first edge of the body, the first edge having a first planar edge face at least partially defining a plane perpendicular to the first magnetic axis;

a second magnet disposed in the body, the second magnet having an outer surface that is symmetrical about a second magnetic axis and at least one planar face that is perpendicular to the second magnetic axis, the second magnetic axis aligned with the center of the body, the at least one planar face of the second magnet disposed adjacent to a second edge of the body, and the second magnetic axis generally perpendicular to the second edge of the body, the second edge having a second planar edge face at least partially defining a plane perpendicular to the second magnetic axis;

a third magnet disposed in the body, the third magnet having an outer surface that is symmetrical about a third magnetic axis and at least one planar face that is perpendicular to the third axis, the third magnetic axis aligned with the center of the body, the at least one planar surface of the third magnet disposed adjacent to a third edge of the body, and the third magnetic axis generally perpendicular to the third edge of the body, the third edge having a third planar edge face at least partially defining a plane perpendicular to the third magnetic axis; and a ferromagnetic ball releasably and magnetically coupled to the body by the first magnet, the body having a first face and a second face opposite to the first face, the body having a polygonal shape with a beveled corner when viewed in a direction facing the first face, the beveled corner comprising the first edge of the body, the first magnetic axis bisecting the beveled corner when viewed in a direction facing the first face, and the first face and the second face being parallel to the first magnetic axis, the second magnetic axis, and the third magnetic axis, the body defining a recess directly over the at least one planar face of each of the first, second, and third magnets such that the at least one planar face of the each of the first, second, and third magnets is uncovered and is surrounded by nonmagnetic material so as to provide a pocket for receiving a portion of the ferromagnetic ball, and the recess shaped to contact the ferromagnetic ball along a circumferential line so as to align the center of the ferromagnetic ball with the respective magnetic axis of the respective magnet such that the ferromagnetic ball is adjacent one pole of the respective magnet and spaced from the opposite pole of the respective magnet.

2. The toy construction element of claim 1, the first, second, and third magnetic axes radially spaced equally around the center of the body.

3. The toy construction element of claim 1, the at least one planar surface of the first magnet parallel with the first edge of the body, the at least one planar surface of the second magnet parallel with the second edge of the body, and the at least one planar surface of the third magnet parallel with the third edge of the body.

4. The toy construction element of claim 1, the body exposing the at least one planar surfaces of the first, second, and third magnets, and the first, second, and third magnets being fixed in place within the body.

5. The toy construction element of claim 1, further comprising a fourth magnet disposed in the body, the fourth magnet having an outer surface that is symmetrical about a fourth magnetic axis and at least one planar face that is perpendicular to the fourth magnetic axis, the fourth magnetic axis aligned with the center of the body, the at least one planar surface of the fourth magnet disposed adjacent to a fourth edge of the body, and the fourth magnetic axis generally perpendicular to the fourth edge of the body, and the fourth edge having a fourth planar edge face at least partially defining a plane perpendicular to the fourth magnetic axis.

6. The toy construction element of claim 5, the body comprising a quadrilateral polygon, and the first, second, third, and fourth magnetic axes radially spaced equally around the center of the body.

7. The toy construction element of claim 6, the first face and the second face being parallel to the first magnetic axis, the second magnetic axis, the third magnetic axis, and the fourth magnetic axis.

8. The toy construction element of claim 1, the first, second, and third magnetic axes lying in the same plane.

9. The toy construction element of claim 1, the body having a perimeter face disposed transversely between the first face and the second face around the construction element, and the construction element having a first bevel between the first face and the perimeter face and a second bevel between the second face and the perimeter face.

10. The toy construction element of claim 1, the body comprising one of wood, plastic, and metal.

11. The toy construction element of claim 1, the first magnet being cylindrical.

12. A toy construction kit comprising:

a panel element comprising a body made of nonmagnetic material, the body extending substantially in one plane and having a first perimeter face transverse to the plane, a second perimeter face transverse to the plane, and a third perimeter face transverse to the plane, a first magnet disposed in the body, the first magnet having an outer surface that is symmetrical about a first magnetic axis and at least one planar face that is perpendicular to the first magnetic axis, the first magnetic axis aligned with a center of the body, the at least one planar face of the first magnet disposed adjacent to the first perimeter face of the body, and the first magnetic axis generally perpendicular to the first perimeter face of the body, the first perimeter face having a first planar edge surface at least partially defining a plane perpendicular to the first magnetic axis;

a second magnet disposed in the body, the second magnet having an outer surface that is symmetrical about a second magnetic axis and at least one planar face that is perpendicular to the second magnetic axis, the second magnetic axis aligned with the center of the body, the at least one planar face of the second magnet disposed adjacent to a second perimeter face of the body, and the second magnetic axis generally perpendicular to the second perimeter face of the body, the second perimeter face having a second planar edge surface at least partially defining a plane perpendicular to the second magnetic axis; and a third magnet disposed in the body, the third magnet having an outer surface that is symmetrical about a third magnetic axis and at least one planar face that is perpendicular to the third magnetic axis, the third magnetic axis aligned with the center of the body, the at least one planar surface of the third magnet disposed adjacent to a third perimeter face of the body, and the third magnetic axis generally perpendicular to the third perimeter face of the body, the third perimeter face having a third planar edge surface at least partially defining a plane perpendicular to the third magnetic axis; and a ferromagnetic ball releasably and magnetically held against the first perimeter face of the body by the first magnet, and the first magnetic axis, the second magnetic axis, and the third magnetic axis lying in the same plane, the body defining a recess directly over the at least one planar face of each of the first, second, and third magnets such that the at least one planar face of the each of the first, second, and third magnets is uncovered and is surrounded by nonmagnetic material so as to provide a pocket for receiving a portion of the ferromagnetic ball, and the recess shaped to contact the ferromagnetic ball along a circumferential line so as to align the center of the ferromagnetic ball with the respective magnetic axis of the respective magnet such that the ferromagnetic ball is adjacent one pole of the respective magnet and spaced from the opposite pole of the respective magnet.

13. The toy construction kit of claim 12, the panel element having a polygonal shape with a beveled corner when viewed from a direction perpendicular to the plane, the first perimeter face disposed at the beveled corner, and the first magnetic axis bisecting the beveled corner when viewed from the direction perpendicular to the plane, and the first magnet being fixed in place within the body.

14. The toy construction kit of claim 13, the panel element having curved sides when viewed from a direction perpendicular to the plane.

15. The toy construction kit of claim 12, the panel element further comprising a fourth perimeter face transverse to the plane, and a fourth magnet disposed in the body, the fourth magnet having an outer surface that is symmetrical about a fourth magnetic axis and at least one planar face that is perpendicular to the fourth magnetic axis, the fourth magnetic axis aligned with the center of the body, the at least one planar surface of the fourth magnet disposed adjacent to a fourth perimeter face of the body, and the fourth magnetic axis generally perpendicular to the fourth perimeter face of the body, the fourth perimeter face having a fourth planar edge surface at least partially defining a plane perpendicular to the fourth magnetic axis, the first, second, third, and fourth magnetic axes radially spaced equally around the center of the body.

16. A toy construction element comprising:

a body made of nonmagnetic material and extending substantially in one plane, the body having a first face parallel to the plane, a second face opposite to the first face and parallel to the plane, a first edge between the first face and the second face, a second edge between the first face and the second face, a third edge between the first face and the second face and opposite to the first edge, a fourth edge between the first face and the second face and opposite to the second edge, a first planar edge face between the first edge and the second edge when viewed from a direction perpendicular to the plane, a second planar edge face between the second edge and the third edge when viewed from the direction perpendicular to the plane, a third planar edge face between the third edge and the fourth edge and opposite to the first planar edge face, when viewed from the direction perpendicular to the plane, a fourth planar edge face between the fourth edge and the first edge and opposite to the second planar edge face, when viewed from the direction perpendicular to the plane, the first planar edge face perpendicular to the second planar edge face, the second planar edge face perpendicular to the third planar edge face, the third planar edge face perpendicular to the fourth planar edge face, and the fourth planar edge face perpendicular to the first planar edge face, when viewed from a direction perpendicular to the plane;

a first magnet fixedly disposed in the body, the first magnet having an outer surface that is symmetrical about a first magnetic axis and at least one planar face that is perpendicular to the first magnetic axis, the first magnetic axis aligned with a center of the body, the at least one planar face of the first magnet disposed adjacent to and parallel to the first planar edge face of the body, and the first magnetic axis generally perpendicular to the first planar edge face of the body;

a second magnet fixedly disposed in the body, the second magnet having an outer surface that is symmetrical about a second magnetic axis and at least one planar face that is perpendicular to the second magnetic axis, the second magnetic axis aligned with the center of the body, the at least one planar face of the second magnet disposed adjacent to and parallel to the second planar edge face of the body, and the second magnetic axis generally perpendicular to the second planar edge face of the body;

a third magnet fixedly disposed in the body, the third magnet having an outer surface that is symmetrical about a third magnetic axis and at least one planar face that is perpendicular to the third magnetic axis, the third magnetic axis aligned with the center of the body, the at least one planar face of the third magnet disposed adjacent to and parallel to the third planar edge face of the body, and the third magnetic axis generally perpendicular to the third planar edge face of the body;

a fourth magnet fixedly disposed in the body, the fourth magnet having an outer surface that is symmetrical about a fourth magnetic axis and at least one planar face that is perpendicular to the fourth magnetic axis, the fourth magnetic axis aligned with the center of the body, the at least one planar face of the fourth magnet disposed adjacent to and parallel to the fourth planar edge face of the body, and the fourth magnetic axis generally perpendicular to the fourth planar edge face of the body; and a ferromagnetic ball releasably and magnetically held against the first planar edge face by the first magnet, the ferromagnetic ball having a geometric center, the first and third magnetic axes being coincident, the second and fourth magnetic axes being coincident, and the first and second magnetic axes being perpendicular, when viewed from the direction perpendicular to the plane, and the first magnetic axis, the second magnetic axis, the third magnetic axis, and the fourth magnetic axis being coplanar and parallel to the plane of the body.

17. The toy construction element of claim 16, the first, second, third, and fourth edges being curved when viewed from a direction perpendicular to the plane.

18. The toy construction element of claim 1, wherein the ferromagnetic ball has a geometrical center that lies along the first magnetic axis.

19. The toy construction element of claim 1, wherein a longest side of the first face of the body comprises a width of the body, wherein a distance between the first face and the second face comprises a thickness of the body, and wherein the width is at least eight times greater than the thickness.

20. The toy construction element of claim 12, wherein a longest side of the body measured along the one plane is at least eight times greater than the thickness of the body measured transverse to the one plane.

21. The toy construction element of claim 12, wherein the width of the planar face of the first magnet is at least 80% of the thickness of the body measured transverse to the one plane.

22. The toy construction element of claim 12, wherein the radius of the ferromagnetic ball is greater than the thickness of the body measured transverse to the one plane.

23. The toy construction element of claim 12, wherein the diameter of the ferromagnetic ball is at least three times greater than the width of the planar face of the first magnet.

24. The toy construction element of claim 12, the body further having:

a first curved perimeter face disposed between the first perimeter face and the second perimeter face, and a second curved perimeter face disposed between the second perimeter face and the third perimeter face, wherein the first curved perimeter face and the second curved perimeter face are curved when viewed in a direction facing the plane.

25. The toy construction element of claim 1, wherein each of the first planar edge face, the second planar edge face, and the third planar edge face has a generally rectangular perimeter.

26. The toy construction element of claim 9, wherein each of the first planar edge face, the second planar edge face, and the third planar edge face has a generally hexagonal perimeter.

27. The toy construction element of claim 1, wherein the construction element is a first construction element, and the first planar edge face of the first construction element is configured to allow the magnetic attachment of a second construction element as claimed in claim 1 along a first planar edge face of the second construction element such that the first construction element and the second construction element are held together by magnetic force and in abutment along planar surfaces.

28. The toy construction element of claim 16, the body defining a recess directly over the at least one planar face of each of the first, second, third, and fourth magnets such that the at least one planar face of the each of the first, second, third, and fourth magnets is uncovered and is surrounded by nonmagnetic material so as to provide a pocket for receiving a portion of the ferromagnetic ball, and the recess shaped to contact the ferromagnetic ball along a circumferential line so as to align the center of the ferromagnetic ball with the respective magnetic axis of the respective magnet such that the ferromagnetic ball is adjacent one pole of the respective magnet and spaced from the opposite pole of the respective magnet.

* * * * *